US005186577A

United States Patent [19]

Reicin et al.

[11] Patent Number: 5,186,577

[45] Date of Patent: Feb. 16, 1993

[54] SECONDARY CONTAINMENT SYSTEM FOR MANHOLES AND THE LIKE

[75] Inventors: Edward E. Reicin, Skokie; Rano J. Bertolozzi, Des Plaines; Theodore Cortapassi, Dolten, all of Ill.

[73] Assignee: MPC Containment Systems, Ltd., Chicago, Ill.

[21] Appl. No.: 715,437

[22] Filed: Jun. 14, 1991

[51] Int. Cl.[5] ..... B65G 5/00; B65B 3/06

[52] U.S. Cl. ..... 405/52; 137/312; 141/86

[58] Field of Search ..... 405/52, 53, 55, 303; 141/86; 137/312, 363; 220/85 F, 85 S, 86.1; 222/108

[56] References Cited

U.S. PATENT DOCUMENTS

| | | | |
|---|---|---|---|
| 4,659,251 | 4/1987 | Petter et al. | 405/52 |
| 4,958,957 | 9/1990 | Berg et al. | 405/52 X |
| 4,960,346 | 10/1990 | Tamayo | 405/52 |
| 5,044,822 | 9/1991 | Moss | 405/52 |
| 5,101,868 | 4/1992 | Balch | 141/86 |
| 5,114,271 | 5/1992 | Sunderhaus | 405/52 |

*Primary Examiner*—David H. Corbin

*Attorney, Agent, or Firm*—Laff, Whitesel, Conte & Saret

[57] ABSTRACT

The invention provides secondary containment for liquid carrying equipment which is in a confined area. The invention is especially well suited for retrofitting manholes containing pumps for underground gasoline distribution systems. The pumps or other equipment are removed to expose pipes or wires entering the manhole. Then, plates are bolted around the pipes or wires to engage and support a bag made of a material which resists the attack of the liquid. Holes are cut in the bag to pass the pipes or wires. The bag is placed in the hole, expanded to approximately fill hole, to rest on the plates, and is sealed to the plates, pipes, or wires. The top of the bag is gathered and closed to resist entry of ground water.

12 Claims, 2 Drawing Sheets

SECONDARY CONTAINMENT SYSTEM FOR MANHOLES AND THE LIKE

This invention relates to secondary containment systems for collecting spills from equipment mounted in confined spaces, such as manholes or the like, and more particularly to pollution control collection of spills from turbine pumps in underground gasoline distribution systems.

Related apparatus is shown in U.S. Pat. Nos. 4,682,91; 4,778,310; 4,818,151; and U.S. Pat. Application Ser. No. 07/557,202, filed July 24, 1990, all owned by the same assignee.

The Environmental Protection Agency ("EPA") prescribes rules and regulations calculated to guard against certain predictable environmental disasters. Underground gasoline storage tanks and delivery systems provide an example of a place where the EPA has been extremely active. A typical EPA requirement requires the emplacement of a secondary containment system under the tanks, pipes, pumps, or the like in order to capture any leaking fluid. For example, the above identified patents describe a large rubber or rubber-like sheet or membrane which is placed under the tanks or the like. Then the edges of the sheet are raised to be vertical in order to form basin containing the tank. If the tank should leak gasoline, it is captured in the basin from which it may be pumped.

Among other things, the underground delivery facilities may include pumps and similar protected devices which may require frequent servicing, maintenance, replacement, or the like. Usually, these devices are installed in confined spaces such as manholes or vaults which may be closed during operation, but which must be open and accessible upon demand.

The term "manhole" equipment is used herein after to generically described any such confined space and any of this type of equipment therein, with out regard to whether it is in a manhole, a vault, a housing or the like.

It is desirable to place a secondary containment system in the manhole so that if the pump or other protected equipment should leak, the leakage will be collected for disposal as opposed to leaching into the ground. The secondary containment system should be resistant to an infiltration or invasion of ground or surface water. Still, the protection against such as infiltration or invasion must not make it difficult to gain easy access to the protected equipment for servicing, repair, or replacement. Moreover, it would also be very expensive if the installation of secondary containment systems requires more than a minimum amount of time to install and remove, especially in manholes with existing equipment.

Yet another consideration is that substantial numbers of the equipment of the described type have already been installed. It would be not only prohibitively expensive but also difficult for society to function, if this protected equipment had to be replaced and service disrupted. Conversely, society would have to pay too high a social price if the underground water supply is further contaminated by leaching gasoline.

Accordingly, an object of this invention is to provide new and improved means for and methods of providing secondary containment especially for manholes or other installations in confined spaces. Here, an object is to form secondary containment systems with closed tops that tend to resist infiltration of ground or surface water. In this connection, an object is to provide such a top which may be opened quickly and easily for service, maintenance, or replacement and then reclosed for operation.

Still another object of this invention is to provide secondary containment systems which may be installed with existing equipment at a minimum of expense and bother. Here, an object is to provide for installations which do not require any cutting of existing cement or concrete.

In particular, an object of the invention is to meet EPA requirements for retrofitting sumps containing turbine pumps.

In keeping with an aspect of this invention, these and other objects are accomplished by a bag having a drawstring top. The bag is made of a rubberized membrane which is resistant to attack by gasoline, alcohol, or other fluid that may be encountered in the manhole. Examples of such membranes are given in the above cited patents. Templates are formed to cut holes in the bag at points where pipes or electrical wires are to enter it. Then, on opposite sides of the membrane, plates are secured around such pipes or wires with a sealant added to seal the membrane to the plates and pipes. The drawstring top may be closed in order to resist an invasion of surface or ground water or opened to provide for service, replacement, or repair.

Preferred embodiments are shown in the attached drawings, in which.

Figure 1:
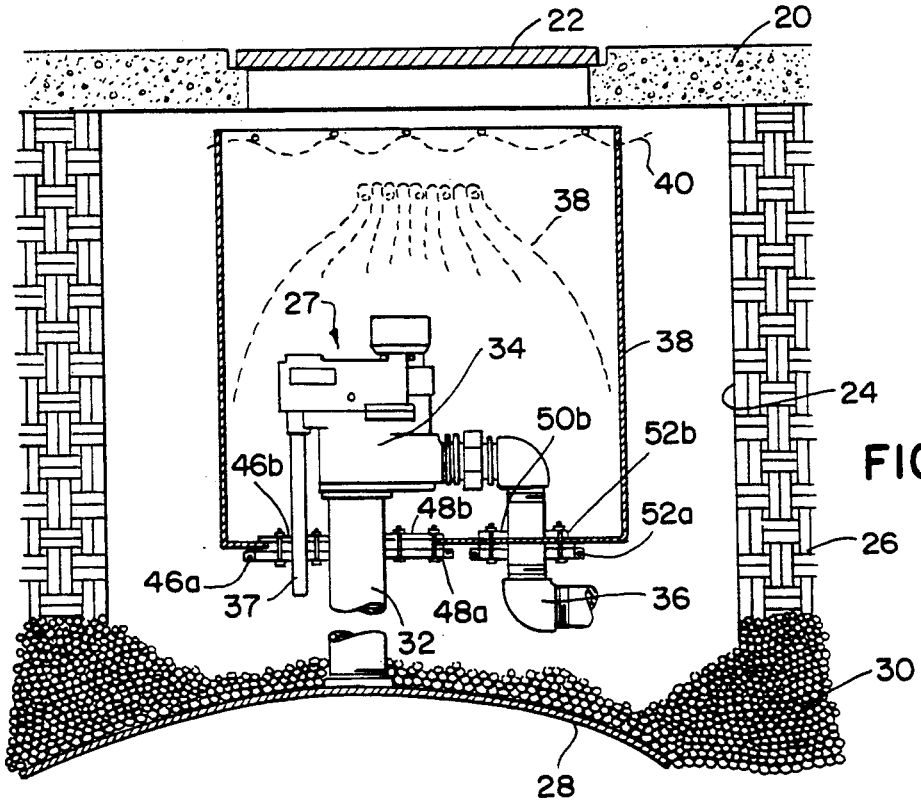
FIG. 1 is a stylized showing of a side elevation of an installation of a pump, pipes, and wiring in a pre-existing manhole.

FIG. 1 shows an exemplary installation under a concrete driveway 20 with a manhole cover 22 therein. A suitable vault 24 is buried under the concrete and in the earth 26 to provide a confined space for receiving equipment 27 which is to be protected. The reference numeral 28 identifies the top of an underground gasoline storage tank 29 which is buried in gravel ballast 30. Attached to the top 28 of the tank is a pipe 32 extending to a turbine pump 34. A penetration pipe 36 extends from the pump 34. The pump 34 is powered by electrical energy supplied via wire 37. These two pipes 32, 36 and wire 37 represent any suitable pipes or wirings or other similar device that may be required in the confined space within the manhole.

For present purposed, it is irrelevant whether the pump 34 is delivering gasoline into or removing gasoline from the tank 28. The point is that there may be leakage which must be contained within the manhole vault 24.

The equipment 27 described thus far may have been installed many years ago; or, it may be a new installation. Either way, it should be easy to install a secondary containment system at a relatively low cost. Such a system includes a bag 38, which is made of a rubberized fabric that is sealed around the riser pipe 32, wire 37, and penetration pipe 36, or any other pipes or wires that may be required by the equipment 27. A drawstring rope 40 may be pulled and tied to close and pinch off the top of the bag (shown in dashed lines) in order to resist an infiltration of surface or ground water. Or the rope 40 may be released to open the top of the bag (shown in dashed lines) 38 for servicing, maintaining, or replacing the pump 34 or other fittings.

The material used to make the membrane depends upon the chemical properties of the liquid in the tanks, pipes, and pumps. Preferred materials may be selected and used in connection with any of many different types of liquids, as taught in the above identified patents. The preferred membrane material for gasoline containment includes a DuPont polyester elastomer sold under the trademark "HYTREL". In general, the resultant membrane resists the same classes of chemicals and fluids that polyurethanes resist polyurethanes. Moreover, a membrane made of "HYTREL" does not contain an extractable plasticizer, as do some vinyls, nylon and rubber compounds. The membrane is also resistant to deterioration when placed in most hot moist environments.

The preferred procedure for making the membrane, which has these characteristics and which meets these specifications, is to first provide a loosely woven scrim, approximately 2,000 denier, which is made of polyester fibers. Then, a liquid form of HYTREL is used to coat the scrim on both sides and to fill in the openings between the fibers, with the scrum suspended in a manner so that its fibers become embedded in the middle of the finished sheet thickness dimension. At room temperature, the resulting membrane is resistant to most polar fluids-such as acids, bases, amines glycols, gasoline oil, hydraulic fluid and the like.

Figure 2:
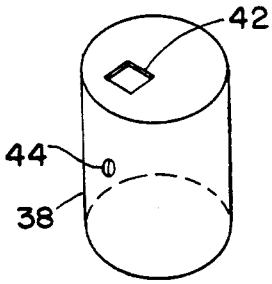
FIG. 2 is a perspective view of the inventive bag prepared for a side and bottom entrance and exit of pipes and wires.
Figure 3:
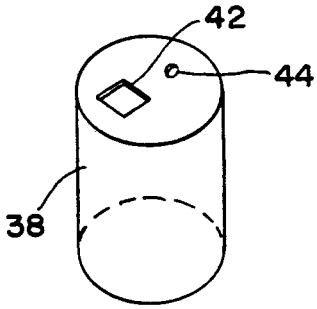
FIG. 3 is perspective view of a similar bag having both a entrance and exit on the bottom.
Figure 4A:
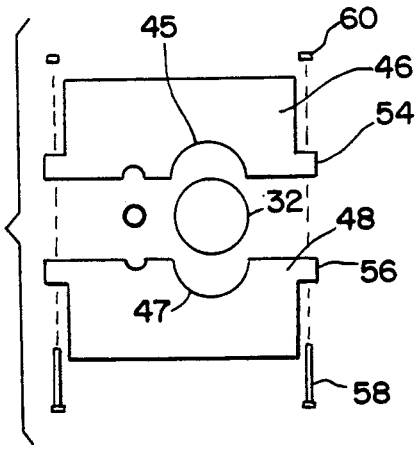
FIGS. 4A and 4B are exploded views of plates for enabling a pump riser, wire and pipe to penetrate the inventive bag.
Figure 4B:
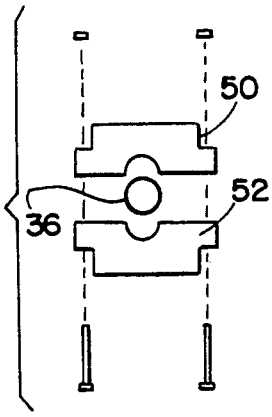

FIGS. 2 and 3 show the bag 38 as it may be originally manufactured in a factory and later modified in the field for a specific installation. In order to prepare for an installation, careful measurements are made to determine where the riser pipe, wire and penetration pipes are located. Then, a template is used to be sure that the hardware will fit through holes to be cut in the bag. These templates are used to transfer the measurements to the bag. Finally, hole 42 is cut to receive the riser pipe 32, wire 37 and hole 44 is cut to receive the penetration pipe 36. In FIG. 2, the penetration pipe 36 enters hole 44 at the side of the bag 38. In FIG. 3, the penetration pipe enters hole 44 at the bottom of the bag 38.

In order to seal the bag 38 to the pipes, 46–52 are formed to surround each of the pertinent pipes and wires. Each of the plates is preferably a flat, generally rectangular plate with a cove (such as 45, 47) formed at each location where a pipe or wire may enter the bag 38. When the confronting coves come together, they surround and fit against the outside perimeter of the pipe or wire. In a like manner, are also formed wherever required to fit tightly around a perimeter of a pipe.

Figure 5A:
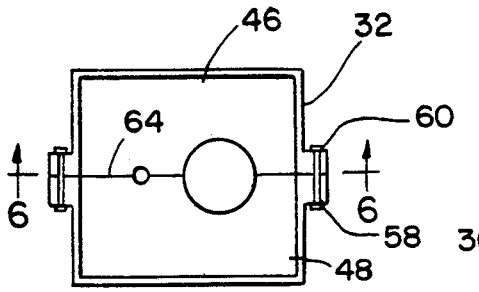
FIGS. 5A and 5B are assembled views of the plates of FIGS. 4A and 4B.
Figure 5B:
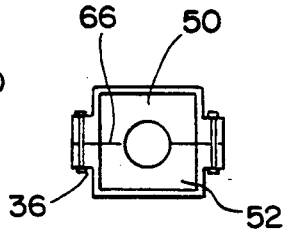
Figure 6:
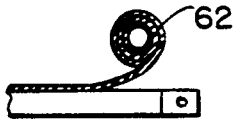
FIG. 6 is a cross-section stop motion view taken along line 6—6 of FIG. 5A and showing an application of sealing tape which may be used to seal together the plates of FIGS. 5A and 5B.

Each of the plates has a pair of flanges associated therewith, as shown at 54, 56, for example. Suitable bolts (such as 58) pass through these flanges and are secured is place by nuts (such as 60), as shown in FIG. 5. A suitable adhesive sealing tape 62 (FIG. 6) is placed over the crack 66 between the plates and around the pipes. Also, a liquid, paste, or gel sealant may be placed between the plates, pipes, and membrane in order to seal them together in a manner which contains any fluid which may leak into the bag.

Figure 7:
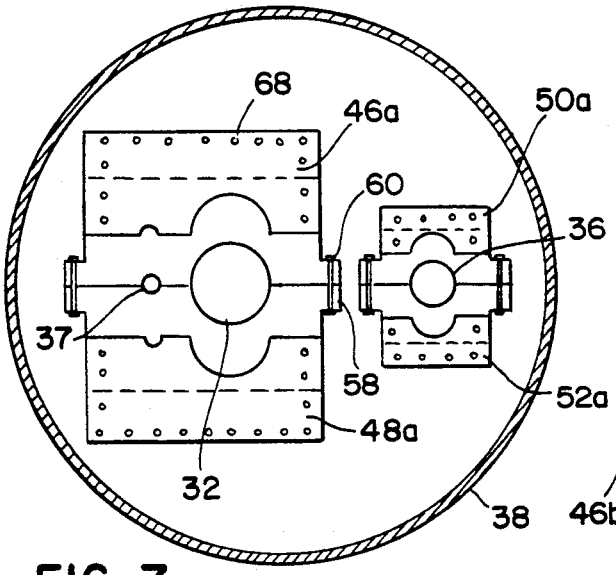
FIG. 7 is an exploded view which shows an alternative set of plates for giving entrance to the pump riser, wire and penetration pipe.
Figure 8:
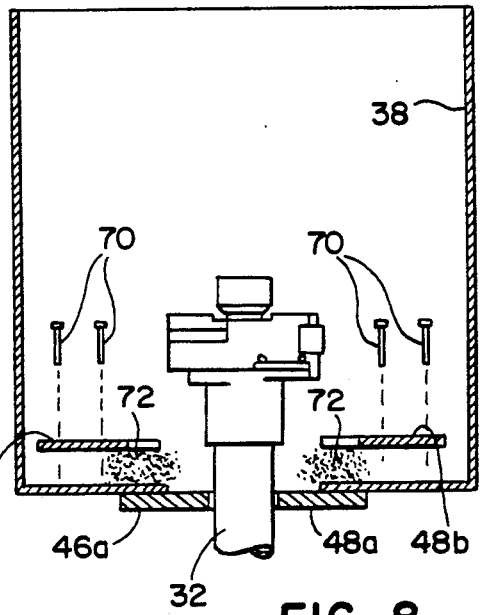
FIG. 8 is an exploded view showing an installation of the plates of FIG. 7.

In the example of FIG. 7, each of the plates **46*a*–52*a* has a number of peripheral bolt holes (such as 68) formed therein. Thus, the plates 46*a*, 48*a*, for example, are assembled around the riser pipe 32 (FIG. 8) and wire 37. Then, the plates are secured in place by bolts such as 58 and nuts such as 60. Bag 38 is put into place over the plates 46*a*, 48*a*. Then, similar 46*b*, 48*b* (FIG. 8) are assembled around riser 32, wire 37 and above the bag 38. Finally, bolts (such as 70) are turned into the holes (such as 68) to tighten plates 46*b*, 48*b* against plates 46*a*, 48*a* with the membrane 38 sandwiched therebetween. A suitable sealant 72 may be added between the plates 46*a*, 48*a* and 46*b*, 48*b***, depending upon the specific needs of any given installation.

Figure 9:
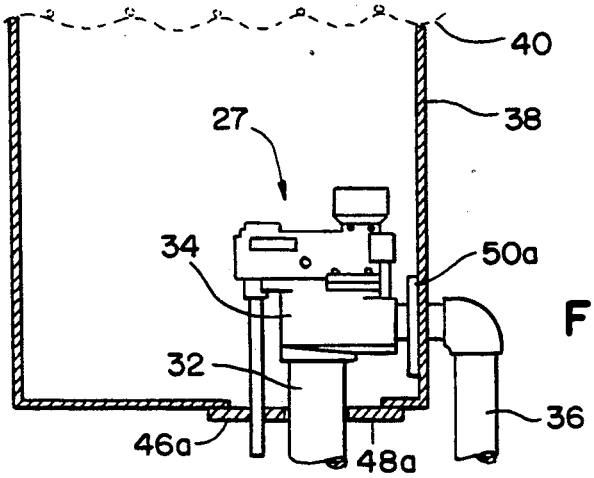
FIG. 9 shows an assembly providing a bottom entry for the pump riser and a side entry for the penetration pipe.

FIG. 1 shows the invention used in an embodiment wherein the riser 32, wire 37, and penetration pipe 36 enter at the bottom of the bag 38. In FIG. 9, the penetration pipe 36 enters at the side while the riser 32 and wire 37 enter at the bottom of the bag 38. Otherwise, the construction is substantially the same in both FIG. 1 and FIG. 9. When the draw string rope 40 is pulled, the top of bag 38 is gathered (dashed lines, FIG. Then the rope 40 is tied to hold the top closed in order to entry of surface or ground water. To service equipment the rope 40 is untied and the top of the bag is spread.

The advantages of the invention should now be clear. The bag 38 provides a secondary containment system for suitable equipment 27, such as turbine sump pumps, for example. A unique feature of the system is that it can be installed through the existing manholes, which greatly reduces the inset cost and disruption of businesses. As an added benefit pinch off top closure minimizes water infiltration and yet provides easy access to the turbine for serving.

Those who are skilled in the art will readily perceive how to modify the invention. Therefore, the appended claims are to be construed to cover all equivalent structures which fall within the true scope and spirit of the invention.

We claim:

1. A secondary containment system for protecting against fluids leaking from equipment in confined spaces, said secondary containment system comprising an open top bag made of a flexible membrane which resists attack by liquids carried by said equipment, closure means at the top of the bag for gathering, pinching in and securing the top of said flexible bag in order to close said bag and resist entry of water or to open and spread the top in order to give access for servicing the equipment, at least one hole formed at a selected location in said bag at a point where devices enter said bag in order to give access to said equipment; means surrounding said devices and tightly fastened on opposite sides of said membrane, and sealing means between said surrounding means and said membrane.

2. The system of claim 1 wherein said equipment is part of a gasoline distribution system and said confined space is a manhole, said equipment including means for pumping gasoline through said distribution system, and devices comprise at least one pipe or wire coupled to said pump.

3. The system of claim 2 wherein all of said devices enter the bottom of said bag.

4. The system of claim 2 wherein some of said devices enter the bottom of said bag and other of said devices enter a side of said bag.

5. The system of claim 2 wherein each of said surrounding means includes plates having coves formed therein to surround 180° of the perimeter of a pipe, or wire and flanges on said plates which may be bolted together so that a pair of plates tightly fit against and surround said pipe or wire.

6. A secondary containment system for retrofitting fixtures in underground gasoline distribution systems, said fixtures being installed in an area having a restricted volume, said secondary containment system comprising a flexible bag made of a membrane which resists an attack by gasoline and having contours and proportions which substantially fit inside the area of said restricted volume, whereby said bag may be stuffed into and then expanded to substantially fill the interior of said volume, at least one hole formed in said bag at any convenient location which is selected in order to fit said bag to any give location to provide a passage for pipes or wirings and thus to tailor said bag to an individual fixture, and means surrounding said pipes or wirings for sealing them to said membrane forming said bag, whereby said bag may be tailored to accommodate existing installations, and means for folding said flexible bag to close its top.

7. The system of claim 6 wherein said bag has means at its top for closing it to resist an entry for ground water while enabling said bag to open for servicing said fixture.

8. The system of claim 7 wherein said surrounding means comprises plates which come together in face to face contact with contours of said plates surrounding a 360° perimeter of said pipes or wirings, and means for bolting said plates together and around said pipe or wirings.

9. The system of claim 8 and means for sealing said plates to said membrane.

10. A method of retrofitting a limited underground area containing equipment carrying a liquid in order to provide secondary containment of spillage of said liquid, said method comprising the steps of:

(a) removing some of the equipment from said area to expose wires or pipes entering said area;

(b) providing a bag which substantially fills the contours of said area, said bag being made of a flexible material which resists an attack by said liquid;

(c) cutting at lest one hole in said bag at any convenient location which is selected to receive said existing wires or pipes which may enter said area;

(d) securing plates around said wires or pipes at any suitable level or levels which engage an outside surface of said bag surrounding any hole cut in Step C when said bag is installed in said area;

(e) installing said bag with the hole or holes passing over said pipes or wires to rest upon said plates and expanding said bag to substantially conform to the contours of said area;

(f) sealing said bag to said plates and pipes or wires;

(g) returning and rejoining equipment removed in step (a); and (h) folding the top of said bag in order to close it.

11. The method of claim 10 wherein step (f) includes the added stop of securing other plates around said wires or pipes and in engagement with an inside surface of said bag surrounding the hole or holes cut in Step C.

12. The method of claim 11 wherein step (f) includes the further step of placing a sealant between said bag, plates, and pipes or wires.

* * * * *